US005938182A

United States Patent [19]

Goodrich et al.

[11] Patent Number: 5,938,182

[45] Date of Patent: Aug. 17, 1999

[54] POWER CARPET STRETCHER GAUGE

[75] Inventors: Gary Goodrich, Union City; Howard G. McGaha, Pleasanton, both of Calif.

[73] Assignee: Orcon Corporation, Union City, Calif.

[21] Appl. No.: 08/880,783

[22] Filed: Jun. 23, 1997

[51] Int. Cl.[6] ..... B25B 25/00

[52] U.S. Cl. ..... 254/209; 254/200; 294/8.6; 73/862.635; 73/862.392; 73/862.393

[58] Field of Search ..... 254/200, 209; 294/8.6; 73/862.631, 862.635, 862.391, 862.392, 862.393

[56] References Cited

U.S. PATENT DOCUMENTS

| | | | |
|---|---|---|---|
| 549,044 | 10/1895 | Zander . | |
| 639,718 | 12/1899 | Dexter . | |
| 3,153,772 | 10/1964 | Dorr | 73/862.635 X |
| 3,228,248 | 1/1966 | Li et al. | 73/862.635 X |
| 3,311,347 | 3/1967 | Thompson . | |
| 4,084,787 | 4/1978 | Kowalczyk . | |
| 4,230,302 | 10/1980 | Crain | 254/212 |
| 4,576,053 | 3/1986 | Hatamura | 73/862.631 X |
| 4,627,653 | 12/1986 | Koroyasu | 294/8.6 |
| 4,628,583 | 12/1986 | Barnett | 73/862.635 X |
| 4,912,984 | 4/1990 | McMennanmy et al. | 73/862.635 X |
| 5,190,328 | 3/1993 | Anderson | 294/8.6 |
| 5,392,660 | 2/1995 | Hodson et al. | 73/862.393 |
| 5,483,842 | 1/1996 | Foreman | 73/862.392 |

OTHER PUBLICATIONS

Standard Reference Guide for Installation of Residential Textile Floorcovering Materials, CRI 105–1990 ISBN # 0–89275–030–8, p. 21, 30, 41, 47.

Roberts Floor Covering Products Catalogue, Roberts Consolidated Industries, P.O. Box 1250, 800 N. Baldwin Park Boulevard, City of Industry, California 91749, pp. 17–19.

Crain Floor Covering Tools Catalogue No. 119c, p. 4,5. Crain Cutter Co. Inc., 156 So. Milpitas Blvd., Milpitas, Ca, 95035.

*Primary Examiner*—Donald P. Walsh
*Assistant Examiner*—Emmanuel M. Marcelo
*Attorney, Agent, or Firm*—Medlen & Carroll, LLP

[57] ABSTRACT

A gauge including a housing mounted as a telescoping extension section in a power stretcher unit between the transfer tube and the baseplate. At one end of the housing is a connector for mating the housing to one point on the power stretcher, a chamber and a socket communicating with the chamber; at an opposite end of the housing is a movable piston which is slidably received in the socket at the first end, and a connector for mating the housing to a second point on the power stretcher. A sensing device is mounted in the chamber which senses the movement of the piston towards the chamber as occurs when a force is applied to stretch the carpet. Finally, a display, such as a gauge dial or digital display, can be connected to the sensing device for indicating to the operator of the power stretcher the force applied by the carpet stretcher to the carpet.

24 Claims, 9 Drawing Sheets

POWER CARPET STRETCHER GAUGE

FIELD OF THE INVENTION

The present invention relates to the field of carpet installation devices; and is more particularly to devices for power stretching carpets in wall to wall carpeting installations.

BACKGROUND OF THE INVENTION

The installation of wall-to-wall carpeting often involves stretching the carpet to obtain a smooth, flat installation. This generally entails installing tack strips around the perimeter of the area to be covered with carpet adjacent to the walls of the area. The carpet is then rolled out in the room, usually over some padding, rough cut and seamed. One side of the carpet is attached to the tack strip along one side of a room and then stretched to the other side where the carpet is attached to an opposing tack strip. This process removes any wrinkles or creases in the carpeting, resulting in a flat, safe and visually appealing carpet installation.

During the above-described method of installing carpets, the carpet installer uses various tools for stretching the carpet. A common tool is the power stretcher. The power stretcher is generally composed of three parts: (1) a head, which is typically constructed from a head having a plurality of downwardly extending carpet gripping members for anchoring the head on the carpet; (2) an anchor for anchoring the stretcher; and (3) a transfer section, including a lever arm mechanism for transferring the force delivered by a downward stroke of the lever arm to the head to stretch the carpet. Power stretchers are typically provided with telescoping extension members which can be used to increase the length of the transfer section as needed.

There are two general types of power stretchers. The first type, typified by U.S. Pat. Nos. 4,084,787 to Kowalczyk, 639,718 to Dexter, and 549,044 to Zander, all stretch the carpet towards the anchor point which is typically secured by nailing to the floor or by inserting a blade behind a tack or tackless strip which has been nailed to the floor. The second type, which is the type most commonly used, is typified by U.S. Pat. No. 4,230,302 to Crain Jr. The Crain power stretcher includes a head with downwardly extending carpet securing pins, a transfer tube section, and an anchor. A sliding bar is attached at a first end to the rear of the head. The second end of the sliding bar telescopes into a first end of the transfer tube. The transfer tube can be extended by means of telescoping extension members which freely accept the sliding bar. An anchor is attached to a second end of the transfer tube for engaging a wall. A pivoting handle is attached to the rear of the carpet engaging head, and extends towards the anchor. In between the ends of the handle is located a linkage that pivotally connects the handle to the transfer tube. When the handle is depressed towards the transfer tube, the head is forced away from the transfer tube and the wall engaged by the anchor.

The kind of carpet being installed dictates the amount of force used to stretch the carpet. High quality carpeting, with very strong, dense, multiple layer backings typically require a higher amount of force to stretch. Economy carpeting, with minimal, single layer backings, require a lower force to stretch. In either case, applying too much force during the stretching process can damage the carpet and/or result in an unsightly installation.

Unfortunately, most conventional power carpet stretchers do not include any device for indicating how much force is being applied to the carpet being stretched. U.S. Pat. No. 3,311,347 to Thompson discloses a stretching device with two stretching heads separated by a threaded force exerting means, and including a pressure responsive scale, such as a bathroom scale, for measuring the force applied to the carpet by the threaded force exerting means. However, the scale in the '347 patent is disclosed as having a range from 0–300 pounds. Such a device would not be adequate for stretching carpets or measuring the force applied to stretch carpets in a modern installation where it is not unusual for forces well in excess of 300 pounds and up to as much as 1,000 pounds to be applied during stretching.

Accordingly, the need exists for a device for accurately measuring the force delivered by a conventional power stretcher for carpets, and which can be mounted to an existing power stretcher without the need to modify the power stretcher.

SUMMARY OF THE INVENTION

In one embodiment, the present invention provides a gauge for measuring the force imparted to a carpet by a power stretcher having a stretching head with anchoring elements for anchoring the head to a section of carpet, a baseplate disposed against a wall, a transfer tube interposed between the baseplate and the head for housing in telescoping fashion a sliding rod attached to a rearward portion of the head, and a lever arm means mounted for pivoting movement at one end to said rear portion of said head, having a handgrip at an opposite end, and mounted at an intermediate point between the rear portion of the head and the handgrip to a pivoting fulcrum means mounted to said transfer tube, so that when the lever arm is forced downwards towards the transfer tube, the head is forced away from, and the transfer tube is forced towards, the wall. The gauge of this embodiment includes a housing having a first part comprising an internal chamber and a socket communicating with the chamber, and a second part comprising a piston means mounted in the socket. Telescoping means are provided for mounting the housing between the transfer tube and one of its extensions or the baseplate. A pressure sensing means for measuring the force applied by the carpet stretcher to the carpet is mounted in the chamber, and functions by detecting the motion of the piston towards or into the chamber. The pressure sensing means is operably attached to a display to provide the operator of the carpet stretcher with a visual, real-time indication of the force being applied to the carpet.

In another embodiment, the present invention provides an improved power stretcher for carpets incorporating a force gauge of the present invention.

In yet another embodiment, the gauge of the present invention detects the force imparted to the piston by the carpet stretcher using an electronic strain gauge assembly.

In yet another embodiment, the gauge of the present invention detects the force imparted to the piston by the carpet stretcher using an electro-magnetic assembly.

In yet another embodiment, the gauge of the present invention detects the force imparted to the piston by the carpet stretcher using a hydraulic or pneumatic assembly.

BRIEF DESCRIPTION OF THE DRAWINGS

The objects, features and advantages of the present invention will become apparent to one skilled in the art from reading the following detailed description in which.

DETAILED DESCRIPTION OF THE INVENTION

Figure 1A:
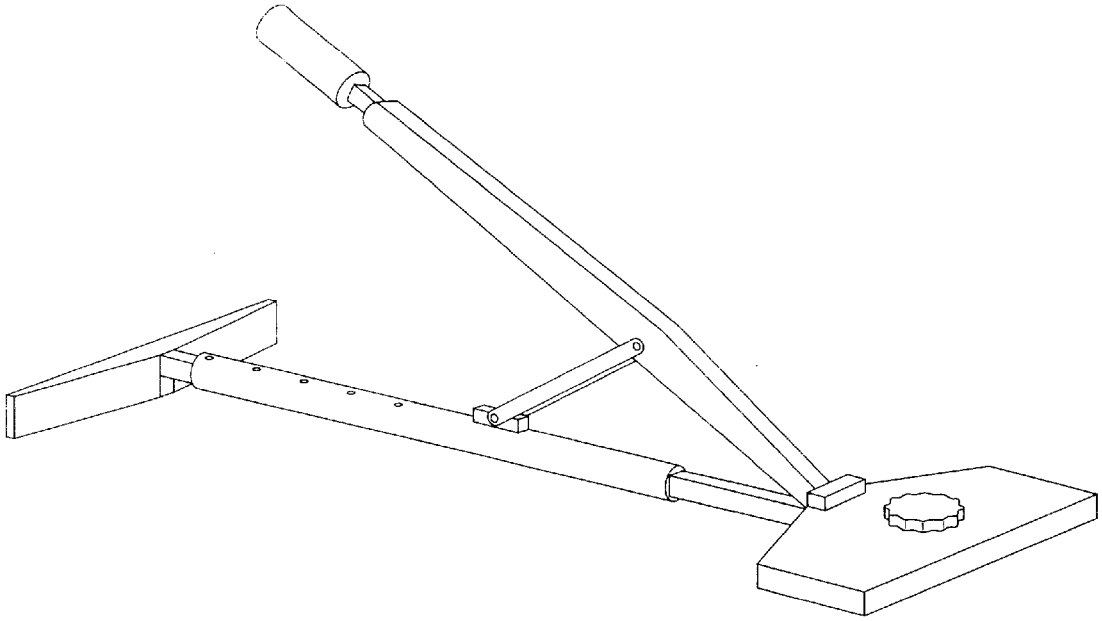
FIG. 1A (PRIOR ART)
FIG. 1A is a perspective view of a conventional power stretcher for carpets.
Figure 1B:
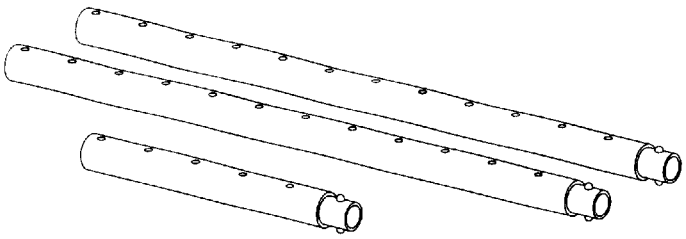
FIG. 1B (PRIOR ART)
FIG. 1B is a perspective view of extension member attachments for use with a conventional power stretcher.

As shown in FIG. 1A, a conventional power stretcher for stretching carpets typically includes a head 10 with downwardly extending carpet engaging members 12 such as, for example, needles. An adjustment knob 14 may be provided for adjusting the depth to which the carpet engaging members 12 can engage the carpet. A sliding rod 16 is pivotally mounted at one end to the back of the head 10. The opposite end of sliding rod 16 telescopes into a first end of transfer tube 22. An anchor 26 for anchoring one end of the stretcher is mounted to a sliding rod 28, the free end of which telescopes into the second end of transfer tube 22. A locking pin 30, which is preferably a pair of spring loaded detents extending from either side of the sliding bar 28, is used to engage one selected pair, of the several pairs provided, of locking pin apertures 34 which extend through opposite sides of the transfer tube 22 wall to secure the sliding bar 28 in a desired position relative to the transfer tube 22. Transfer tube extension members 24, 24', 24" of varying lengths are available for insertion between the second end of transfer tube 10 and sliding bar 28, to create a transfer tube section having a desired length. A lever arm 18 is pivotally mounted at one end to the back of head 10. A handle or hand grip is provided at the opposite end of lever arm 18. A pair of pivoting links 32 connect the transfer tube 22 and the lever arm 18 at a point intermediate the first end and handle of the lever arm and at a point intermediate the first and second ends of the transfer tube. To stretch carpet, the operator engages the carpet with the head 10 at a desired position and raises the lever arm 18. The anchor 26 is placed against the surface of a wall opposite the tack or tackless strip the carpet is being stretched towards, by adding extension members 24, 24', 24" (as shown in FIG. 1B) as necessary and by sliding the sliding bar 28 relative to transfer tube section until the anchor 26 is pressed firmly against the wall surface. The operator then depresses the lever arm 18 by pushing the handle 20 towards the transfer tube section, driving the head 10 away from the transfer tube section. A locking mechanism 17 may be provided to maintain the position of the extended head once the handle 20 has been depressed sufficiently to provide a desired amount of stretch, to enable the operator to secure the stretched carpet to the tack or tackless strip. More detail regarding this conventional power stretcher may be found in U.S. Pat. No. 4,230,302 to Crain, Jr., which is incorporated herein by reference.

Figure 2:
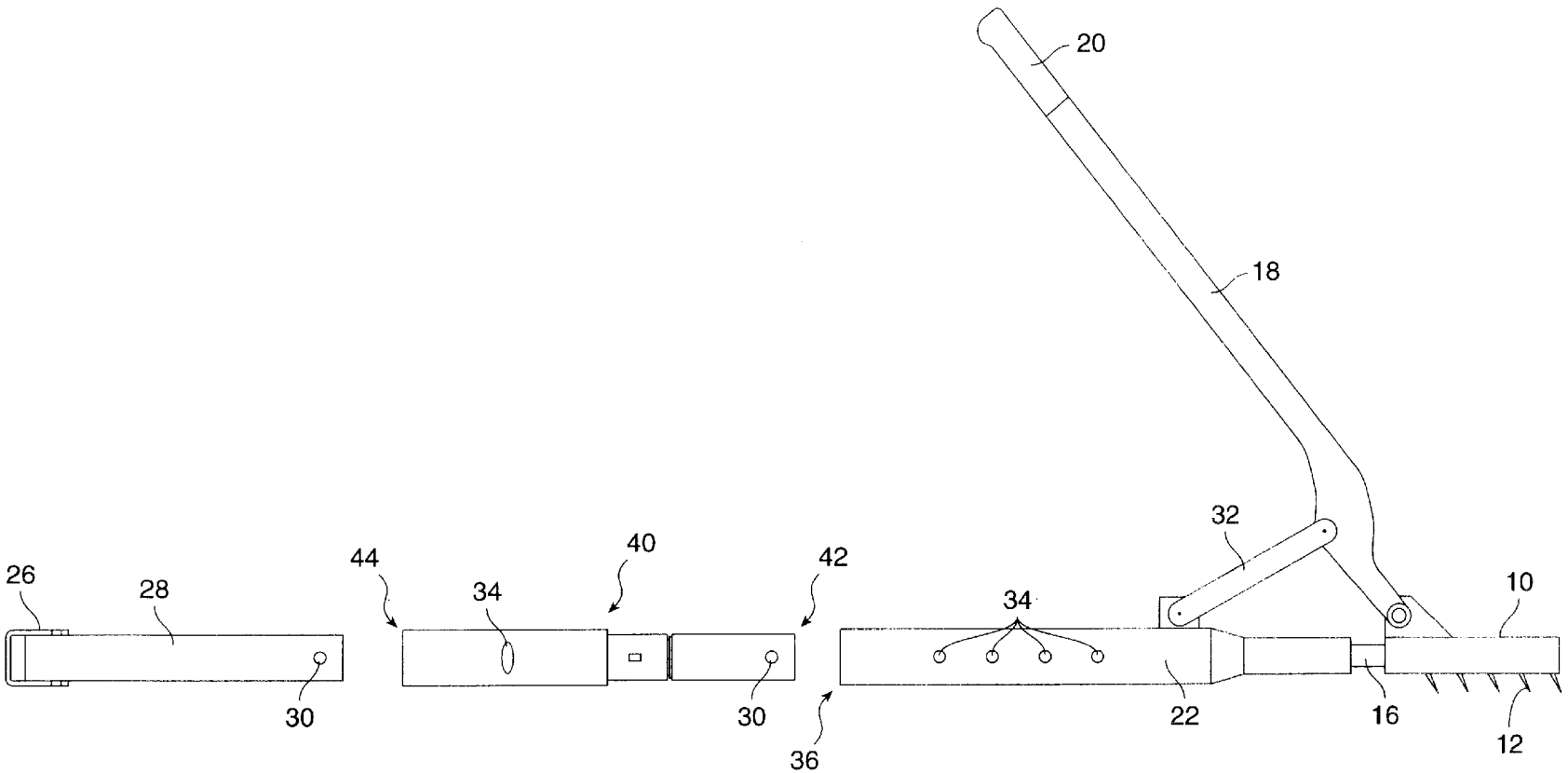
FIG. 2 is a side view of a conventional power stretcher disassembled with a gauge of the present invention in position for mounting into the transfer section.
Figure 3:
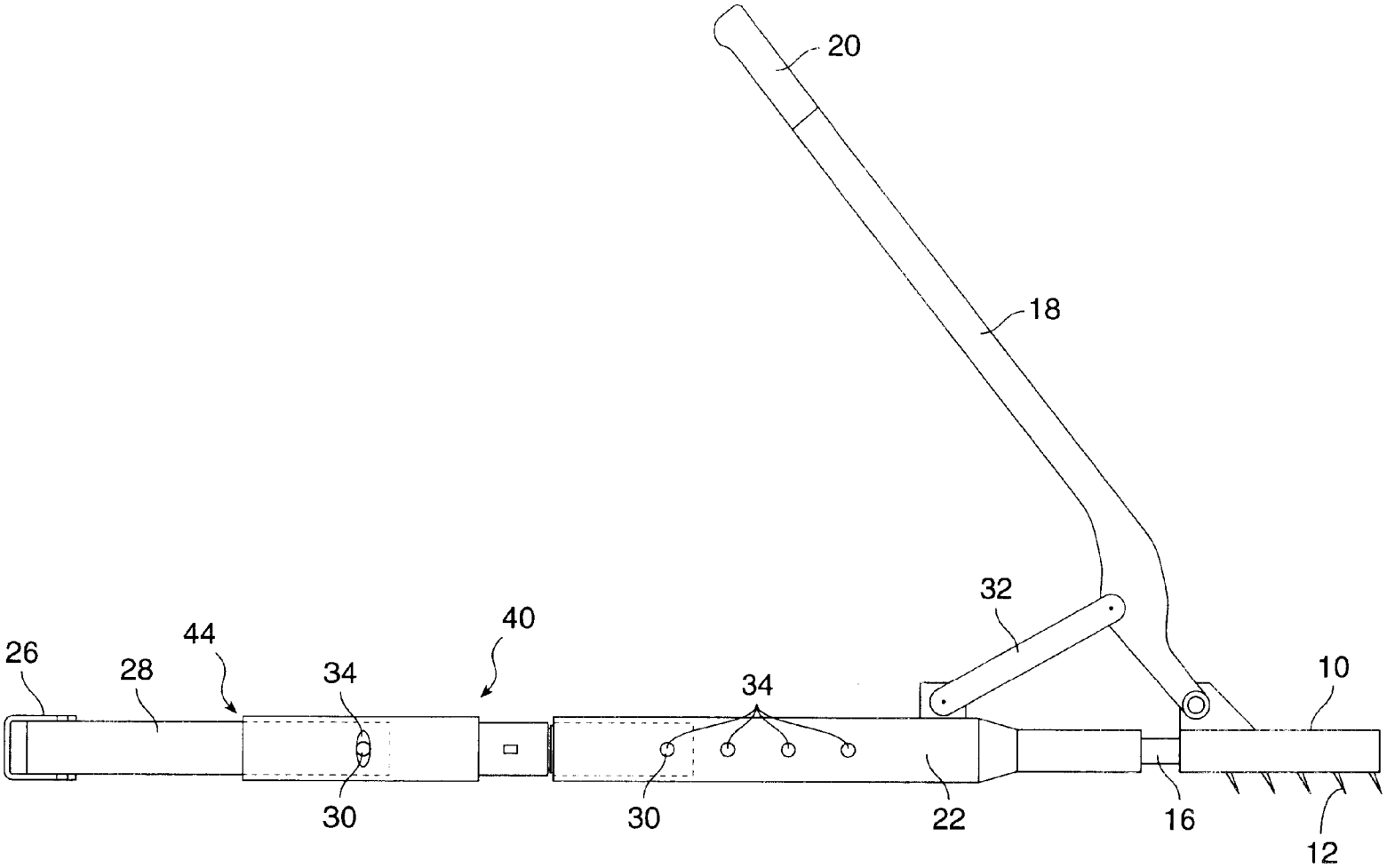
FIG. 3 is a side view of the power stretcher of FIG. 2 reassembled with a gauge of the present invention mounted in the transfer section.

As shown in FIGS. 2 and 3, a conventional power stretcher can be improved by providing a gauge 40 for measuring the force applied through the lever arm 18 to stretch the carpet. Gauge 40 is preferably provided with a first end 42 adapted to engage and mate with the second end 36 of transfer tube 22. Most preferably, first end 42 is so adapted by providing a telescoping portion which can engage the second end of transfer tube 22 without any modification of transfer tube 22; however, it would be possible to use a variety of other well-known coupling means to mate the first end of the gauge 40 with the second end of transfer tube 22. In the preferred embodiment, a locking pin 30, which is preferably a spring-loaded detent, extends through both sides of the gauge 40 housing to engage a selected pair of opposing apertures 34 provided through the wall of the transfer tube 22. A second end 44 of gauge 40 is, likewise, adapted to engage and mate with sliding tube 28 or any extension members 24 to which sliding rod 28 has been telescoped into. Once again, a telescoping engagement is preferred, with the sliding rod 28 or extension member 24 sliding into the opening of the gauge at second end 44 until the preferred spring detent 30 is engaged in the aperture 34, locking the gauge 40 in position. The installed position of this preferred embodiment is shown most clearly in FIG. 3.

Figure 4:
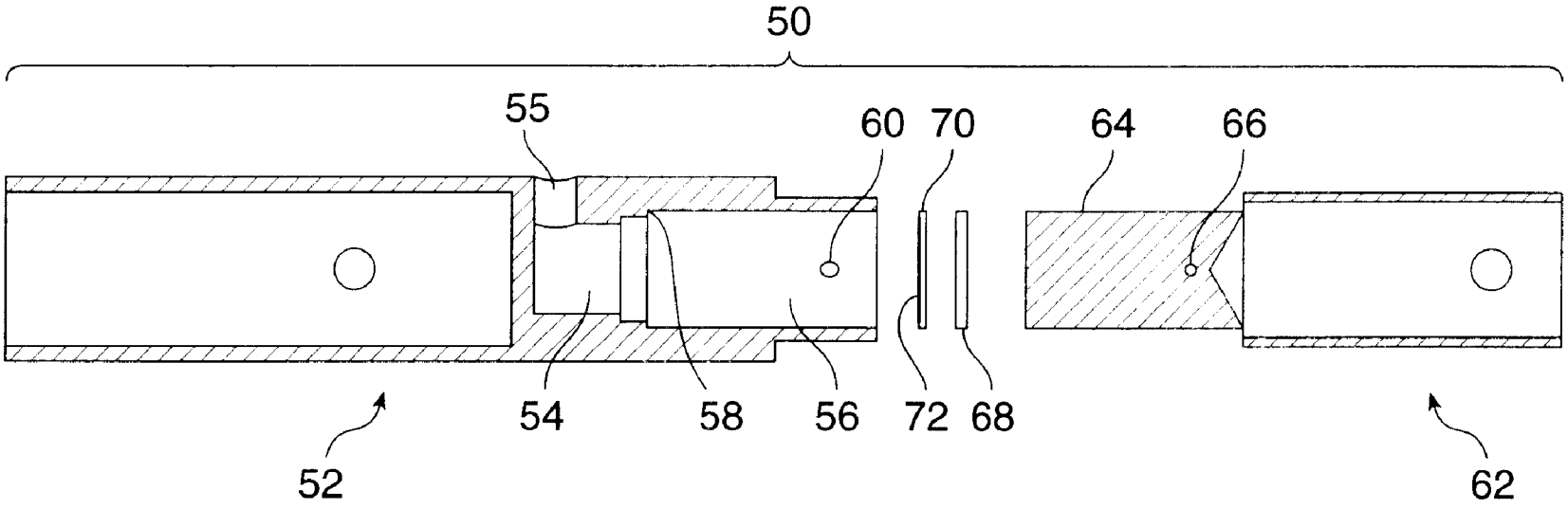
FIG. 4 is a partial, exploded, sectional side view of a gauge of the present invention using electronic sensors for measuring the force applied to the carpet by the power stretcher.
Figure 5:
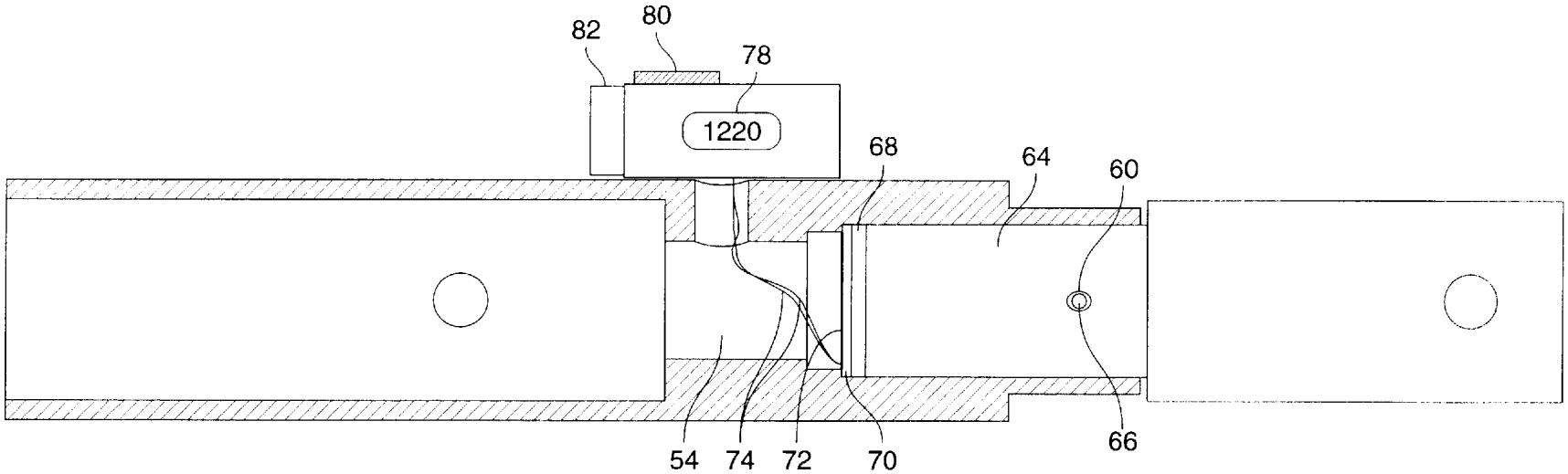
FIG. 5 is a sectional side view of the gauge shown in FIG. 4 as assembled for use.

The most preferred embodiment of a gauge of the present invention is shown in FIGS. 4 and 5. This embodiment consists of a housing 50 preferably composed of two parts: a first, pressure-sensing part 52, and a second, pressure transmitting part 62. Housing 50 can be constructed from any suitably durable material which is compatible with the power stretcher on which the gauge 40 is to be mounted; steel or aluminum is preferred.

The first part 52 of housing 50 includes a chamber 54, with an outlet 55 communicating with the outside surface of the housing 50 and a mounting shoulder 58, a socket 56 for receiving the piston 64 of the second part, a pair of slots 60, 60' for receiving a locking pin 66. Slots 60, 60' and locking pin 66 limit the axial movement of the piston and prevent the piston from being accidentally removed from the first part 52 of housing 50.

The pressure sensing means includes a metal disc 70 sized to fit inside socket 56 and mount against shoulder 58. On one side of metal disc 70, and mounted to be positioned inside chamber 54, is a conventional electronic strain gauge assembly 72. The preferred strain gauge assembly is a circular, encapsulated diaphragm strain gauge which can be adhesively mounted to the side of metal disc 70, and which provides soldering pads for attaching a wiring harness 74 for transmitting the signal generated to a display 76. Such strain gauges are manufactured and/or sold by, for example, Omega Engineering, Inc. of Stamford, Conn. and Micro Engineering, Inc. of Upland, Calif.

A rubber pad 68 is mounted on the opposite side of a disc or diaphragm 70 constructed from, for example, metal and abutting piston 64. Thus, when the piston 64 is moved towards disc 70 (i.e., as the carpet is being stretched), the force is transmitted through the rubber pad 68 to the disc 70, causing the disc 70 to deflect. The deflection of disc 70 is detected by strain gauge assembly 72, which transmits a signal proportional to the amount of deflection through the wire harness 74. In the preferred embodiment, a controller 76 is provided to receive the signal from the strain gauge assembly 72. The controller 76 can include an analog-to-digital converter for converting an analog signal from the strain gauge to a digital signal. The controller 76 may also include a clock chip for time and date data, components for conditioning the signal, calibrating the gauge, and generating a signal to a digital display 78 or some other suitable display means. A suitable power supply 82, which is preferably a battery, is provided for powering the electronic components of this embodiment. Optionally, a speaker 80 may be provided for generating one or more audible signals when certain predetermined force levels are reached. For example, if a particular carpet should be stretched at between 700 and 900 pounds, the controller could be programmed to generate a first signal when the threshold value of 700 is reached, and a second signal when the maximum value is reached. This would enable the operator to focus his or her attention on the carpet, as opposed to the gauge readout.

Figure 6:
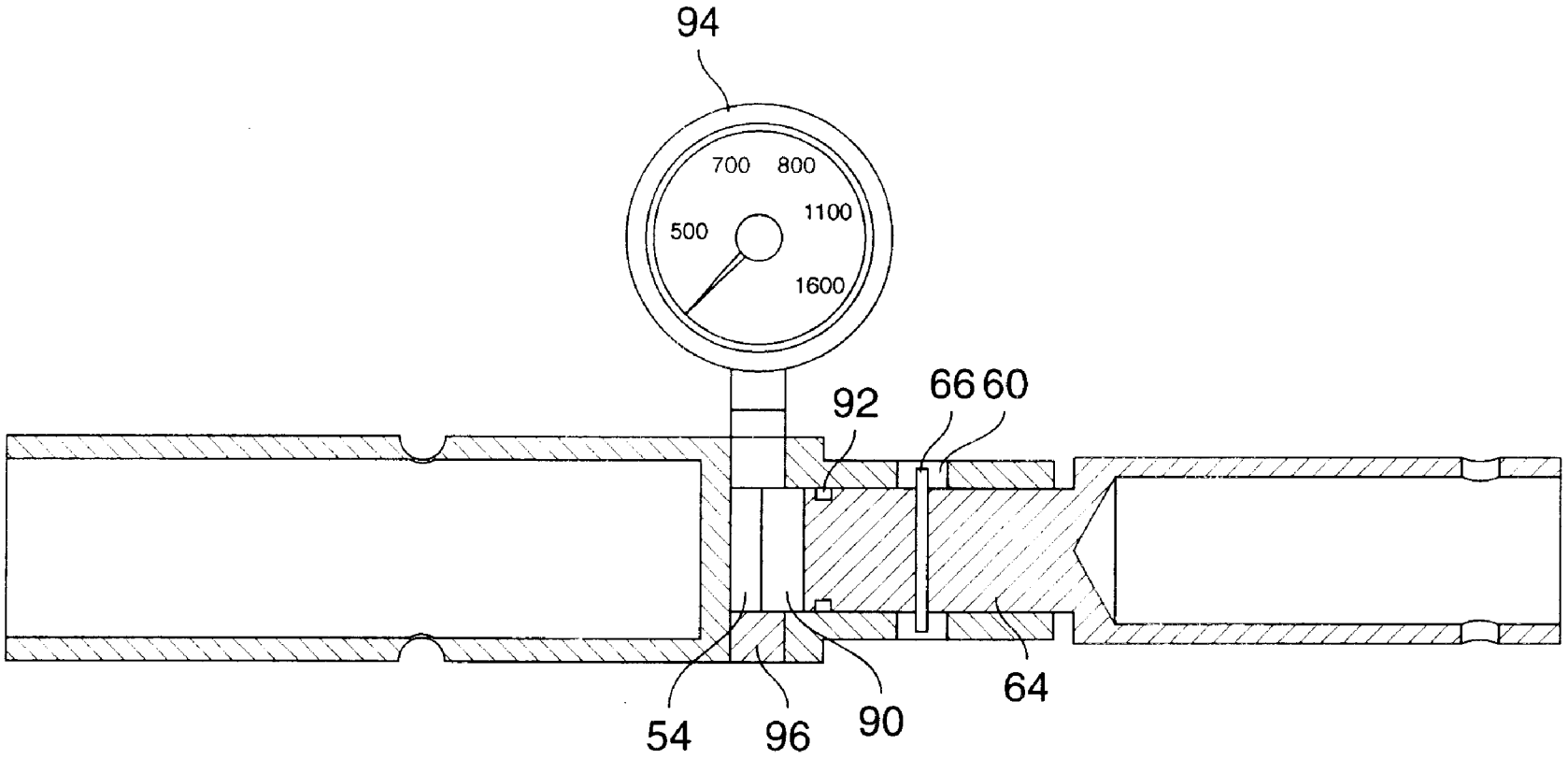
FIG. 6 is a sectional, side view of a gauge of the present invention using a hydraulic or pneumatic sensing means for measuring the force applied to the carpet by the power stretcher.

An alternate, less preferred embodiment of a gauge of the present invention is illustrated in FIG. 6. In this embodiment, socket 56 is bored evenly into chamber 54, eliminating the shoulders shown in FIGS. 4 and 5. As before, the axial movement of piston 64 is constrained by slot 60 and locking pin 66. A conventional, manual pressure gauge is sealed in outlet 55. Chamber 54 is filled with a substantially incompressible fluid, preferably by removing a threaded plug 96, filling the chamber 54, and replacing the threaded plug 96. Additionally, an elastomeric seal 92 can be provided to prevent the loss of the fluid around the piston 64. Thus, when the carpet is stretched, the piston 64 is driven into chamber 54, pressurizing the fluid, and causing the needle on the pressure gauge to move to display the sensed pressure. In the most preferred embodiment of this alternative embodiment, the fluid is oil. However, a gauge could be constructed to use almost any compressible gas or liquid.

Figure 7:
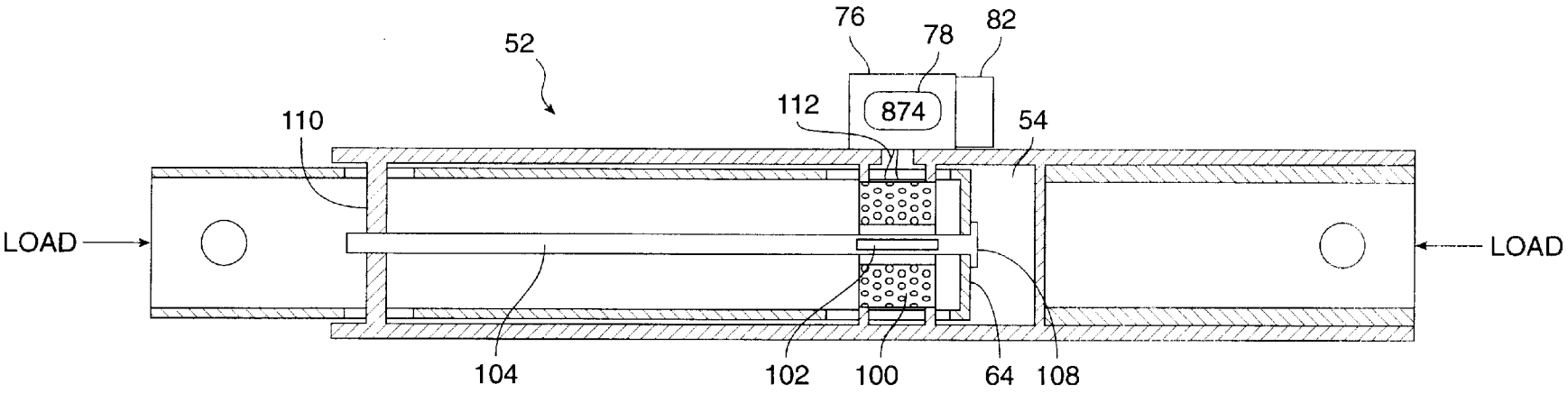
FIG. 7 is a sectional, side view of a gauge of the present invention using a magnetic sensing means for measuring the force applied to the carpet by the power stretcher.

Yet another, least preferred, alternative embodiment is illustrated in FIG. 7. In this embodiment an electromagnet 100 having a core 102 can be mounted to an interior wall of chamber 54 through slots 106, 106' provided through a hollow piston 64, and positioned inside the closed end of piston 64. Mounted for stretching motion through the core 102 is a tensile member 104 which is mounted at its first end 108 to the end of piston 64, and which is mounted at an opposite end to a rod 110 which secures and limits the movement of the piston 64 in the housing. Tensile member 104 can be selected from, for example, any substantially non-magnetic metal such as, for example, stainless steel, aluminum, magnesium, copper, titanium, or alloys thereof. 304 stainless steel is particularly preferred.

Leads 112 transmit the signal generated by the electromagnet 100 when the tensile member 104 is stretched by the forward movement of piston 64. The leads can be connected directly to a display device 78 to provide an inductance measuring device. More preferably, the signal is transmitted to a controller 76, which can be programmed to calibrate the device, and condition the signal. The controller may also interact with other components, such as an analog to digital converter, to convert the analog signal to digital form for processing. An appropriate power supply 82 is provided to power the controller and other electronic components.

Figure 8:
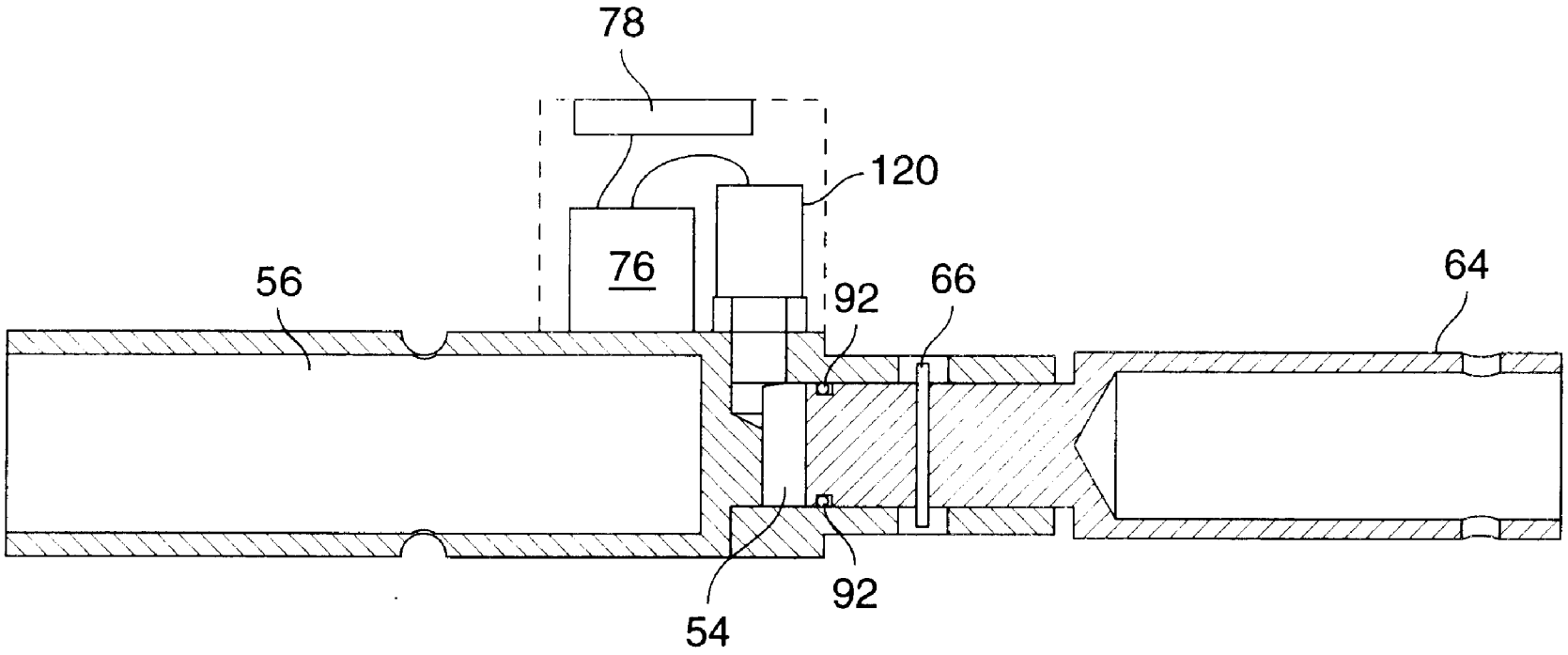
FIG. 8 is a sectional, side view of a gauge of the present invention using a pressure transducer for measuring the force applied to the carpet by the power stretcher.

Another alternative embodiment, using a conventional pressure transducer, is shown in FIG. 8. The basic construction of the housing for this embodiment is similar to that shown in FIG. 6, with the chamber 54 filled with a substantially non-compressible fluid such as, for example, cylinder oil. However, in FIG. 8, a pressure transducer 120 is substituted for the pressure gauge 94 shown in FIG. 6. Pressure transducer 120 can be of any appropriate conventional design such as, for example, the PX300 series manufactured and/or sold by Omega Engineering, Inc. of Stamford, Conn. which provides a stainless steel diaphragm and a silicone oil filled semiconductor sensor providing a 30 millivolt output. The pressure transducer 120 can be connected to a controller 76, to condition and callibrate the signal. A display 78 and a sound generator (not shown) can be operably connected to the controller to provide feedback to the operator of the pressure applied to stretch the carpet. An appropriate power supply (not shown) can be provided to furnish power as required by the components of the device.

Figure 9:
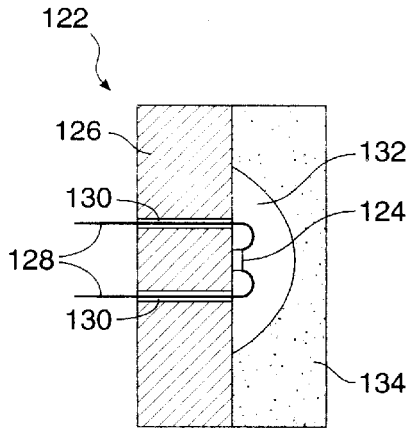
FIG. 9 is a sectional, side view of an alternative transducer device which can be used in a device of the present invention.
Figure 10:
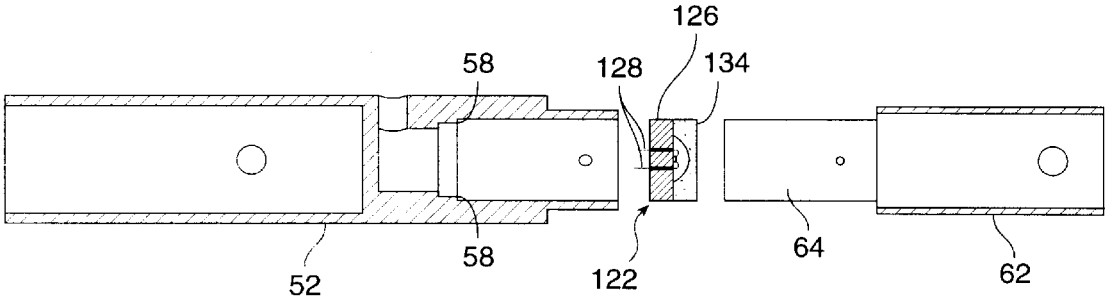
FIG. 10 is an exploded, sectional side view illustrating the use of the device shown in FIG. 9; and, FIG. 11 is a sectional, side view showing the device in FIG. 10 as assembled for use.
Figure 11:
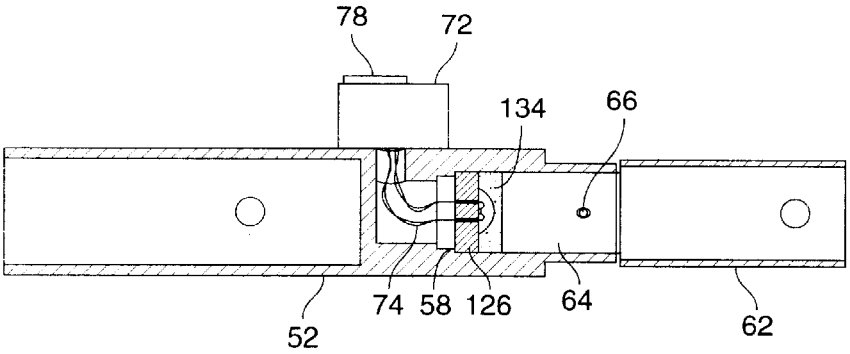

As shown in FIGS. 9–11, an alternative construction using a pressure transducer 122 can be used in the present invention. Pressure transducer 122 includes a transducer chip 124, which may, if desired, include a compensation board. Transducer chip 124 is preferably mounted on a backing plate 126 which may be produced from any suitable material such as, for example, steel. Leads or wires 128 transmitting the signal generated by the transducer chip pass through channels 130 in backing plate 126. Pressure transducer 122 is surrounded by an inner layer of low density compressible material 132 such as, for example, low density silicone. An outer layer of medium density compressible material 134, such as, for example, medium density silicone, preferably covers the inner layer 132 and the front surface of backing plate 126.

As shown in FIGS. 10 and 11, pressure transducer 122 can be mounted in the first end 52 of the housing with the steel plate 126 abutting shoulder 58 and the layer 134 facing the piston 64. The transmission wires 74 are mounted to the pressure transducer leads 128 at one end, and connected at an opposite end to a controller 76, which can be operatively connected to a display 78 and/or a sound generator (not shown) for providing operator feedback. An appropriate power supply (not shown) can be provided to furnish power as required by the components of the device.

The first end 52 of the housing is shown in the drawings as having a socket for receiving telescopically a small end of a transfer tube 22 or extension 24, or sliding rod 28, having spring loaded detents, and the second end 62 of the housing is shown as being provided with a small end and spring loaded detents for insertion into the large end of a transfer tube 22 or extension 24. One skilled in the art will understand that the first end 52 could just as easily be provided with a small end and spring loaded detents for insertion into the large end of a transfer tube 22 or extension 24, and the second end 62 could be provided with a socket for receiving a small end of a transfer tube 22 or extension 24 or sliding rod 28.

The present invention is intended for use with conventional power type stretchers, such as that as shown in FIG. 1. However, one skilled in the art would be able to adapt the device as set forth herein for use with a variety of other power stretchers. For example, the present device could be modified for use with power stretchers which stretch towards the anchor, instead of away from the anchor, such as that shown in U.S. Pat. No. 4,084,787, by modifying the first and second end of the gauge 40 to enable it to be interposed in line with rod 112 between the power stretching head 18 and the base 110.

The invention has been described in terms of the preferred embodiment. One skilled in the art will recognize that it would be possible to construct the elements of the present invention from a variety of materials and to modify the placement of the components in a variety of ways for use with different types of power stretchers. While the preferred embodiments have been described in detail and shown in the accompanying drawings, it will be evident that various further modifications are possible without departing from the scope of the invention as set forth in the following claims.

What is claimed is:

1. In a carpet stretcher having a power stretching head, anchoring elements for anchoring the head to a section of carpet to be stretched, a transfer tube section having one or more telescoping members, a sliding rod having a first end and a second end, said first end of said sliding rod attached to a rear portion of the head, and the second end of said sliding rod disposed for sliding movement in a first end of the transfer tube, a second end of the transfer tube being mounted to a baseplate bearing against a wall, and a lever arm having a first end mounted to the rear portion of the head, a second end having a handgrip, and an intermediate portion bearing against a pivoting fulcrum linkage mounted to the transfer section, whereby when a force is applied to the handgrip to force the lever arm down towards the transfer section, the head is driven away from, and the transfer tube section and baseplate are driven against, the wall against which the baseplate bears to stretch the carpet, wherein the improvement comprises:

a gauge mounted in the transfer tube section of the carpet stretcher for measuring the force being applied to stretch the carpet, the gauge including:

a housing having a first part including a chamber and a socket communicating with said chamber, and a second part including a piston mounted for sliding movement in said socket towards said chamber when force is being applied through the carpet stretcher to stretch the carpet;

a sensing means mounted in said housing for sensing the force transmitted by the piston;

an indicator means connected to said sensing means for indicating to an operator the force applied by the carpet stretcher to the carpet; and a means for mounting said housing in the transfer tube section between the pivoting fulcrum linkage and the baseplate.

2. The carpet stretcher of claim 1 wherein said indicator means is mounted on said housing.

3. The carpet stretcher of claim 1 wherein said sensing means comprises a hydraulic gauge communicating with a supply of fluid contained in said chamber for compression by said piston when a force is applied by the carpet stretcher to the carpet.

4. The carpet stretcher of claim 1 wherein said sensing means comprises:

a metal diaphragm mounted in the chamber;

a rubber pad mounted between a first side of said metal diaphragm and said piston for deflecting said metal diaphragm when said rubber pad is compressed by said piston when a force is applied by the carpet stretcher to the carpet;

an electronic strain gauge means mounted on a second side of said metal diaphragm for generating an electronic signal measuring the deflection of the metal diaphragm and representative of the force applied by the carpet stretcher to the carpet; and, a means for supplying adequate electric power to operate said sensing means.

5. The carpet stretcher of claim 4 wherein said sensing means includes a controller for receiving and conditioning the signal from said electronic strain gauge means and for transmitting to the indicator means a signal representative of the force applied to the carpet by the carpet stretcher.

6. The carpet stretcher of claim 5 additionally including a sound generator connected to said controller for generating at least one audible signal when a predetermined force is sensed by said electronic strain gauges.

7. The carpet stretcher of claim 5 wherein said electronic strain gauge means generates an analog signal, and wherein said sensing means additionally includes an analog to digital converter interposed between said electronic strain gauge means and the controller for converting the analog signal generated by the electronic strain gauge means to a digital signal for processing by the controller.

8. The carpet stretcher of claim 5 wherein said indicator means is a digital display.

9. The carpet stretcher of claim 4 wherein said means for supplying power is a battery.

10. A gauge for measuring the force imparted to a carpet by a power stretcher having a stretching head with anchoring elements for anchoring the head to a section of carpet, a baseplate disposed against a wall, a transfer tube interposed between the baseplate and the head for housing in telescoping fashion a sliding rod attached to a rearward portion of the head, and a lever arm means mounted for pivoting movement at one end to said rear portion of said head, having a handgrip at an opposite end, and mounted at an intermediate point between the rear portion of the head and the handgrip to a pivoting fulcrum linkage mounted to said transfer tube, so that when the lever arm is forced downwards towards the transfer tube, the head is forced away from, and the transfer tube is forced towards, the wall, the gauge comprising:

a housing having a first part comprising an internal chamber and a socket communicating with said chamber, and a second part comprising a piston mounted for sliding movement in said socket;

a means for mounting said housing between said transfer tube and said baseplate;

a sensor in communication with the piston for sensing the force applied by the carpet stretcher to the carpet; and, an indicator connected to the sensor for indicating the force sensed by said sensor.

11. The gauge of claim 10 wherein said indicator is mounted on said housing.

12. The gauge of claim 10 wherein said sensor comprises a mechanical gauge communicating with a supply of fluid contained in said chamber for compression by said piston when a force is applied by the carpet stretcher to the carpet, and wherein said indicator is a scale associated with said mechanical gauge.

13. The gauge of claim 12 wherein said mechanical gauge is hydraulic and the fluid contained in said compartment is a liquid.

14. The gauge of claim 10 wherein said sensor comprises:

a metal diaphragm mounted in the chamber;

a rubber pad mounted between said metal diaphragm and said piston;

an electronic strain gauge means mounted on a side of said metal diaphragm opposite from the side facing said rubber pad, said electronic strain gauge means for generating an electronic signal representative of any deflection sensed in the metal diaphragm; and, a means for supplying adequate electric power to the electronic strain gauge means.

15. The gauge of claim 14 wherein said sensor additionally includes a controller for calibrating the gauge and for receiving and conditioning the electronic signal from the strain gauge means and for transmitting to the indicator a signal indicative of the pressure applied to the carpet by the carpet stretcher which produced the deflection in said metal diaphragm.

16. The gauge of claim 14 additionally including a sound generator means connected to said controller for generating at least one audible signal when a signal is received by the controller from the strain gauge means which indicates that a predetermined force has been applied to the carpet.

17. The gauge of claim 14 wherein said strain gauge means produces an analog signal representative of the force applied by the carpet stretcher to the carpet, and additionally including an analog to digital converter interposed between said strain gauge means and said controller for converting said analog signal from said strain gauge means to a digital signal.

18. The gauge of claim 14 wherein said indicator is a digital display.

19. A gauge for measuring the force imparted to a carpet by a power stretcher having at one end a stretching head with anchoring elements for anchoring the head to a section of carpet and at an opposite end an anchor for securing an end of the power stretcher against a bearing surface, and a transfer tube interposed between the anchor and the head for transferring the force generated by the head to the anchor, and a means linking said head and said transfer tube for moving the head to stretch the carpet, the gauge comprising:

a housing having a first part comprising an internal chamber and a socket communicating with said chamber, and a second part comprising a piston mounted for sliding movement in said socket;

a means for mounting said housing between said stretching head and said anchor whereby said piston will be forced into said socket when said carpet is being stretched;

a sensor for sensing the force applied by the piston; and, an indicator connected to the sensor for indicating to an operator the force sensed by said sensor.

20. The gauge of claim 19 wherein said power stretcher is the type where said head is moved towards said anchor to stretch the carpet.

21. In a carpet stretcher having a power stretching head, anchoring elements for anchoring the head to a section of carpet to be stretched, a transfer tube section having one or more telescoping members, a sliding rod having a first end and a second end, said first end of said sliding rod attached to a rear portion of the head, and the second end of said sliding rod disposed for sliding movement in a first end of the transfer tube, a second end of the transfer tube being mounted to a baseplate bearing against a wall, and a lever arm having a first end mounted to the rear portion of the head, a second end having a handgrip, and an intermediate portion bearing against a pivoting fulcrum linkage mounted to the transfer section, whereby when a force is applied to the handgrip to force the lever arm down towards the transfer section, the head is driven away from, and the transfer tube section and baseplate are driven against, the wall against which the baseplate bears to stretch the carpet, wherein the improvement comprises:

a gauge mounted in the transfer tube section of the carpet stretcher for measuring the force being applied to stretch the carpet, the gauge including:

a housing having a first part including a chamber and a socket communicating with said chamber, and a second part including a piston mounted for sliding movement in said socket towards said chamber when force is being applied through the carpet stretcher to stretch the carpet;

a hydraulic gauge mounted to said housing for sensing the force applied to stretch the carpet by communicating with a supply of fluid contained in said chamber for compression by said piston when a force is applied by the carpet stretcher to the carpet;

an indicator connected to said hydraulic gauge for indicating to an operator the force applied by the carpet stretcher to the carpet; and a means for mounting said housing in the transfer tube section between the pivoting fulcrum linkage and the baseplate.

22. In a carpet stretcher having a power stretching head, anchoring elements for anchoring the head to a section of carpet to be stretched, a transfer tube section having one or more telescoping members, a sliding rod having a first end and a second end, said first end of said sliding rod attached to a rear portion of the head, and the second end of said sliding rod disposed for sliding movement in a first end of the transfer tube, a second end of the transfer tube being mounted to a baseplate bearing against a wall, and a lever arm having a first end mounted to the rear portion of the head, a second end having a handgrip, and an intermediate portion bearing against a pivoting fulcrum linkage mounted to the transfer section, whereby when a force is applied to the handgrip to force the lever arm down towards the transfer section, the head is driven away from, and the transfer tube section and baseplate are driven against, the wall against which the baseplate bears to stretch the carpet, wherein the improvement comprises:

a gauge mounted in the transfer tube section of the carpet stretcher for measuring the force being applied to stretch the carpet, the gauge including:

a housing having a first part including a chamber and a socket communicating with said chamber, and a second part including a piston mounted for sliding movement in said socket towards said chamber when force is being applied through the carpet stretcher to stretch the carpet;

a sensing means mounted to said housing for sensing the force applied to stretch the carpet, wherein said sensing means includes:

a metal diaphragm mounted in the chamber;

a rubber pad mounted between a first side of said metal diaphragm and said piston for deflecting said metal diaphragm when said rubber pad is compressed by said piston when a force is applied by the carpet stretcher to the carpet;

an electronic strain gauge means mounted on a second side of said metal diaphragm for generating an electronic signal measuring the deflection of the metal diaphragm and representative of the force applied by the carpet stretcher to the carpet; and a means for supplying adequate electric power to operate said sensing means;

an indicator connected to the sensing means for indicating to an operator the force applied by the carpet stretcher to the carpet; and a means for mounting said housing in the transfer tube section between the pivoting fulcrum linkage and the baseplate.

23. A gauge for measuring the force imparted to a carpet by a power stretcher having a stretching head with anchoring elements for anchoring the head to a section of carpet, a baseplate disposed against a wall, a transfer tube interposed between the baseplate and the head for housing in telescoping fashion a sliding rod attached to a rearward portion of the head, and a lever arm means mounted for pivoting movement at one end to said rear portion of said head, having a handgrip at an opposite end, and mounted at an intermediate point between the rear portion of the head and the handgrip to a pivoting fulcrum linkage mounted to said transfer tube, so that when the lever arm is forced downwards towards the transfer tube, the head is forced away from, and the transfer tube is forced towards, the wall, the gauge comprising:

a housing having a first part comprising an internal chamber and a socket communicating with said chamber, and a second part comprising a piston mounted for sliding movement in said socket;

a means for mounting said housing between said transfer tube and said baseplate;

a mechanical gauge for sensing the force applied by the carpet stretcher to the carpet, said mechanical gauge communicating with a supply of fluid contained in said chamber for compression by said piston when a force is applied by the carpet stretcher to the carpet; and an indicator connected to the mechanical gauge for indicating to an operator the force sensed by said sensor.

24. A gauge for measuring the force imparted to a carpet by a power stretcher having a stretching head with anchoring elements for anchoring the head to a section of carpet, a baseplate disposed against a wall, a transfer tube interposed between the baseplate and the head for housing in telescoping fashion a sliding rod attached to a rearward portion of the head, and a lever arm means mounted for pivoting movement at one end to said rear portion of said head, having a handgrip at an opposite end, and mounted at an intermediate point between the rear portion of the head and the handgrip to a pivoting fulcrum linkage mounted to said transfer tube, so that when the lever arm is forced downwards towards the transfer tube, the head is forced away from, and the transfer tube is forced towards, the wall, the gauge comprising:

a housing having a first part comprising an internal chamber and a socket communicating with said chamber, and a second part comprising a piston mounted for sliding movement in said socket;

a means for mounting said housing between said transfer tube and said baseplate;

a sensor in communication with the piston for sensing the force applied by the carpet stretcher to the carpet, wherein said sensor includes:

a metal diaphragm mounted in the chamber;

a rubber pad mounted between said metal diaphragm and said piston;

an electronic strain gauge means mounted on a side of said metal diaphragm opposite from the side facing said rubber pad, said electronic strain gauge means for generating an electronic signal representative of any deflection sensed in the metal diaphragm;

a means for supplying adequate electric power to the electronic strain gauge means; and, an indicator connected to the sensor for indicating to an operator the force sensed by said sensor.

* * * * *